US011889939B1

(12) United States Patent
Limber

(10) Patent No.: US 11,889,939 B1
(45) Date of Patent: Feb. 6, 2024

(54) SYSTEM AND METHOD FOR A LOCKING TREE STAND

(71) Applicant: Simple Living Solutions, LLC, Scottsdale, AZ (US)

(72) Inventor: Jamie Limber, Phoenix, AZ (US)

(73) Assignee: Simple Living Solutions, LLC, Scottsdale, AZ (US)

( * ) Notice: Subject to any disclaimer, the term of this patent is extended or adjusted under 35 U.S.C. 154(b) by 9 days.

(21) Appl. No.: 17/738,323

(22) Filed: May 6, 2022

Related U.S. Application Data

(63) Continuation of application No. 17/560,856, filed on Dec. 23, 2021, which is a continuation of application No. 29/801,424, filed on Jul. 28, 2021, now Pat. No. Des. 993,821.

(51) Int. Cl.
*A47G 33/12* (2006.01)

(52) U.S. Cl.
CPC ..... *A47G 33/12* (2013.01); *A47G 2033/1286* (2013.01)

(58) Field of Classification Search
CPC ..... A47G 33/12; A47G 33/1206; A47G 33/1213; A47G 2033/1286
See application file for complete search history.

(56) References Cited

U.S. PATENT DOCUMENTS 5,725,193 A * 3/1998 Adams ..... A47G 33/12 248/524
5,743,508 A * 4/1998 Fiveash ..... A47G 33/12 248/527
5,938,168 A * 8/1999 Adams ..... A47G 33/12 248/524
5,966,864 A * 10/1999 Flink ..... A01G 27/005 47/40.5
2005/0051695 A1* 3/2005 Kovach ..... A47G 33/12 248/524
2005/0167564 A1* 8/2005 Fiveash ..... A47G 33/12 248/523
2006/0226332 A1* 10/2006 Kowalski ..... A47G 33/1213 248/529
2008/0040971 A1* 2/2008 Fiveash ..... A47G 33/12 47/42
2008/0296465 A1* 12/2008 Schommertz ..... A47G 33/1213 248/523
2010/0313471 A1* 12/2010 Middaugh ..... A47G 33/12 47/40.5
2015/0335189 A1* 11/2015 Nally ..... F16M 11/16 248/516
2016/0037951 A1* 2/2016 Meves ..... A47G 33/12 47/40.5

* cited by examiner

*Primary Examiner* — Trinh T Nguyen
(74) *Attorney, Agent, or Firm* — Michelle L. Gross, P.C.

(57) ABSTRACT

A locking tree stand comprising a basin with a plurality of bolt mounts configured to accommodate locking bolts to slide into position. When a tab on the bolt mount is closed a threaded portion of the locking bolt comes in contact with a grip on the tab, preventing the bolt from sliding freely within the bolt mount. The bolt may slide on the thread base where a spring extends from, causing an arm from the spring to push the tab away from the locking bolt, when a locking tab is in an unlocked position. A foot pad may also be attached to the locking screw to provide a greater contact surface between the locking bolt and the trunk of a tree. The footpad may also include a plurality of nubs to provide greater grip between the footpad and the tree trunk.

13 Claims, 11 Drawing Sheets

SYSTEM AND METHOD FOR A LOCKING TREE STAND

CROSS REFERENCE TO RELATED APPLICATIONS

This application is a continuation in part of U.S. application Ser. No. 17/560,856 entitled "System and Method for a Locking Tree Stand" to Jamie Limber filed on Dec. 23, 2021 which claims priority to U.S. application Ser. No. 29/801,424 entitled "Tree Stand" to Jamie Limber, filed on Jul. 28, 2021.

BACKGROUND

1. Field of the Invention

Aspects of this document relate generally to systems and methods for securing a tree in an upright position.

2. Description of Related Art

Trees that have been separated from their roots are often brought into indoor spaces at plant nurseries and in homes during certain holidays. Without a root system, trees are easily unbalanced, and so require a stand or base to secure them in an upright position. Existing stands and bases commonly have a conical shape with the wider section at the bottom to prevent tipping and secure the trunk of the tree within the base via screws or bolts that are inserted at intervals around the base until they are in contact with the trunk. These screws and bolts often have small contact points with the tree, requiring numerous screws to secure a tree. They also often require that the screw or bolt be screwed in at the start of the threaded portion, meaning that a user will have to screw in all the way until contact with the trunk for every screw or bolt that is required. This can be a time consuming and frustrating process, especially since the user or a partner will need to support the tree while it is being secured to the stand.

SUMMARY

Implementations of a locking tree stand may comprise a locking bolt comprising a grip, a threaded portion coupled to the grip, and a head coupled to the threaded portion distal to the grip. The locking tree stand may further comprise a basin comprising an outer wall, an inner wall, an upper edge coupled to the outer wall and the inner wall, and an inner base coupled to the inner wall distal to the upper edge. The upper edge may comprise a plurality of bolt mounts each comprising a thread base positioned between a first opening proximal to the outer wall and a second opening proximal to the inner wall, a space between the first opening and the second opening forming a channel configured to accommodate the locking bolt within a top surface of the thread base, a spring extending from a bottom surface of the thread base, the spring comprising a spring arm that extends above the top surface of the thread base and a tab coupled apically to each of the plurality of bolt mounts and configured to rotate between an open position and a closed position, wherein in the closed position the tab is configured to couple with the threaded portion of the locking bolt and depress the spring arm such that the spring arm is substantially parallel to the top surface of the thread base.

Particular aspects may comprise one or more of the following features. The tab may further comprise a locking lip at a first end proximal to the outer wall of the basin, the locking lip configured to couple with the bolt mount when the tab is in a locked position, the tab configured to slide between the locked position and an unlocked position with the bolt mount while the tab is in the closed position. The locking bolt may further comprise a footpad removably coupled to the head of the locking bolt wherein the footpad is larger than the head of the locking bolt. The footpad may further comprise a plurality of nubs distal to the head of the locking bolt. The basin may be substantially circular and wherein the plurality of bolt mounts are disposed circumferentially along the upper edge. The plurality of bolt mounts may be at substantially regular intervals about the circumference of the upper edge. The tab may couple with the threaded portion of the locking bolt via one or more thread grips extending from a bottom surface of the tab.

Implementations of a locking tree stand may comprise a locking bolt comprising a grip, a threaded portion coupled to the grip, a head coupled to the threaded portion distal from the grip; and a footpad removably coupled to the head and being larger than the head. The locking tree stand may further comprise a basin comprising an outer wall, an inner wall, an upper edge coupled to the outer wall and the inner wall, the upper edge comprising a plurality of bolt mounts each comprising a thread base positioned between a first opening proximal to the outer wall and a second opening proximal to the inner wall, a space between the first opening and the second opening forming a channel configured to accommodate the locking bolt within a top surface of the thread base, a spring extending from a bottom surface of the thread base, the spring comprising a spring arm that extends above the top surface of the thread base, a tab coupled apically to each of the plurality of bolt mounts and configured to rotate between an open and closed position, wherein a ridge extending from the top of the tab may be configured to slide between a locked position and an unlocked position, the tab further may futher comprise a locking lip wherein in the closed position the tab is configured to couple with the threaded portion of the locking bolt and depress the spring arm such that the spring arm is substantially parallel to the top surface of the thread base. The locking tree stand may further comprise an inner base coupled to the inner wall distal to the upper edge.

Particular aspects may comprise one or more of the following features. The tab may further comprise a locking lip at a first end proximal to the outer wall of the basin, the locking lip configured to couple with the bolt mount when the tab is in a locked position, the tab configured to slide between the locked position and an unlocked position with the bolt mount while the tab is in the closed position. The spring may further extend from the bottom of the thread base. The spring arm may be configured to engage with the bottom of the tab such that the spring arm is substantially non-parallel to the top surface of the thread base when the ridge extending from the top of the tab is in the unlocked position. The tab may be configured to depress the spring arm such that the spring arm is substantially parallel to the top surface of the thread base when the ridge extending from the top of the tab is in the locked position. The spring arm may be configured and arranged to angle the tab substantially less than 90 degrees from the top surface of the thread base when the ridge extending from the top of the tab is in the unlocked position.

Implementations of a method for securing a tree in a standing position may comprise placing a tree trunk into a basin, the basin comprising an outer wall, an inner wall, an upper edge coupled to the outer wall and the inner wall, and an inner based coupled to the inner wall distal from the upper edge and inserting a locking bolt into each of a plurality of bolt mounts having a first opening proximal to the outer wall and a second opening proximal to the inner wall, the space between the first opening and the second opening forming a channel configured to accommodate the locking bolt, while a tab coupled apically on each of the plurality of bolt mounts is in an open position. The method may further comprise placing a head of the locking bolt, the head coupled to the threaded portion and distal from a grip of the locking bolt, within a first distance from the tree trunk, screwing in the locking bolt within a thread base of the bolt mount until the head of the locking bolt is in contact with the tree trunk, and sliding a ridge extending from the top of the tab into a closed position, wherein a bottom surface of the tab is configured to depress a spring arm extending from a top surface of the thread base such that the spring arm is substantially parallel to the top surface of the thread base when the tab is in the closed position.

Particular aspects may comprise one or more of the following features. The method may further comprise attaching a footpad to the head of the locking bolt, the footpad being larger than the head of the locking bolt and screwing in the locking bolt until the footpad coupled to the locking bolt is in contact with the tree trunk. The method may further comprise inserting the locking bolt, wherein the threaded portion of the locking bolt engages with the spring extending from the bottom surface of the thread base and sliding the ridge extending from the top of the tab into the unlocked position, wherein the bottom surface of the tab is configured to engage the spring arm such that the spring arm is substantially non-parallel to the top surface of the thread base. The method may further comprise sliding the ridge extending from the top of the tab into the locked position, wherein the tab further comprises a locking lip at a first end proximal to the outer wall of the basin, the locking lip configured to couple with the bolt mount when the tab is in the locked position, the tab configured to slide between the locked position and an unlocked position with the bolt mount while the tab is in the closed position. The basin may be substantially circular and the plurality of bolt mounts may be disposed circumferentially along the upper edge. The plurality of bolt mounts may be at substantially regular intervals about the circumference of the upper edge. The method may further comprise coupling the tab with the threaded portion of the locking bolt via one or more thread grips extending from the bottom surface of the tab and depressing the spring arm such that the spring arm is substantially parallel to the top surface of the thread base.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventor is fully aware that she can be her own lexicographer if desired. The inventor expressly elects, as her own lexicographer, to use only the plain and ordinary meaning of terms in the specification and claims unless she clearly states otherwise and then further, expressly sets forth the "special" definition of that term and explains how it differs from the plain and ordinary meaning. Absent such clear statements of intent to apply a "special" definition, it is the inventor's intent and desire that the simple, plain and ordinary meaning to the terms be applied to the interpretation of the specification and claims.

The inventor is also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventor is fully informed of the standards and application of the special provisions of 35 U.S.C. § 112(f). Thus, the use of the words "function," "means" or "step" in the Detailed Description or Description of the Drawings or Claims is not intended to somehow indicate a desire to invoke the special provisions of 35 U.S.C. § 112(f), to define the invention. To the contrary, if the provisions of 35 U.S.C. § 112(f) are sought to be invoked to define the inventions, the claims will specifically and expressly state the exact phrases "means for" or "step for", and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventor not to invoke the provisions of 35 U.S.C. § 112(f). Moreover, even if the provisions of 35 U.S.C. § 112(f) are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

The foregoing and other aspects, features, and advantages will be apparent to those artisans of ordinary skill in the art from the DETAILED DESCRIPTION, DRAWINGS, and CLAIMS.

BRIEF DESCRIPTION OF THE SEVERAL VIEWS OF THE DRAWINGS

A more complete understanding of the present invention may be derived by referring to the detailed description when considered in connection with the following illustrative figures. In the figures, like reference numbers refer to like elements or acts throughout the figures.

Elements and acts in the figures are illustrated for simplicity and have not necessarily been rendered according to any particular sequence or embodiment.

DETAILED DESCRIPTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention. It should be noted that there are many different and alternative configurations, devices and technologies to which the disclosed inventions may be applied. The full scope of the inventions is not limited to the examples that are described below.

Figure 1:
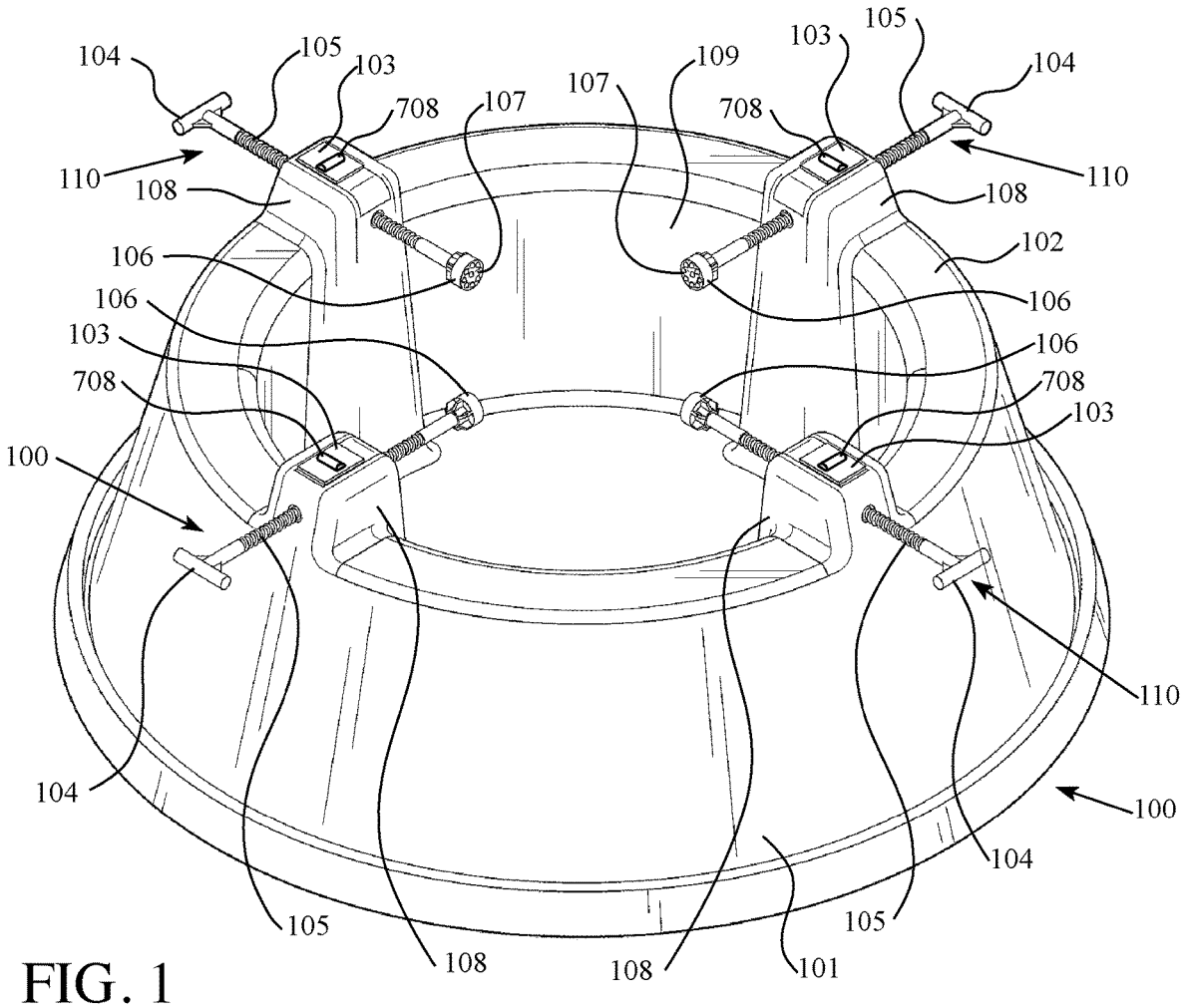
FIG. 1 depicts a top perspective view of an implementation of a locking tree stand with four locking bolts.

The present disclosure relates to systems and methods for securing a tree in an upright position via a series of locking bolts. FIG. 1 shows an exemplary embodiment of a locking tree stand with a basin 100 having four bolt mounts and a locking bolt 110 inserted into each bolt mount 108. In many embodiments the basin 100 has an outer wall 101, an upper edge 102, and an inner wall 109. The basin 100 may serve to hold water or any other suitable liquid to hydrate the tree held by the tree stand. In some embodiments, the basin 100 may optionally comprise a drain plug (not shown). In these and other embodiments the upper edge 102 has a plurality of bolt mounts 108 disposed along its surface. A tab 103 is disposed on the apical side each of the bolt mounts 108. The tab 103 can be moved between an open and closed position and is depicted in a closed position in FIG. 1. In many embodiments when the tab 103 is in a closed position it comes in contact with the threaded portion 105 of the locking bolt 110 and prevents the locking bolt 110 from sliding within the bolt mount 108. In these and other embodiments the grip 104 of the locking bolt 110 can be twisted by a user to screw in or unscrew the locking bolt 110. In many embodiments a footpad 106 may be coupled to the head of the locking bolt 110 providing a larger contact surface with the trunk of a tree. In these and other embodiments the footpad 106 may further have a plurality of nubs 107 at one end providing a higher friction contact surface with the tree.

Figure 2:
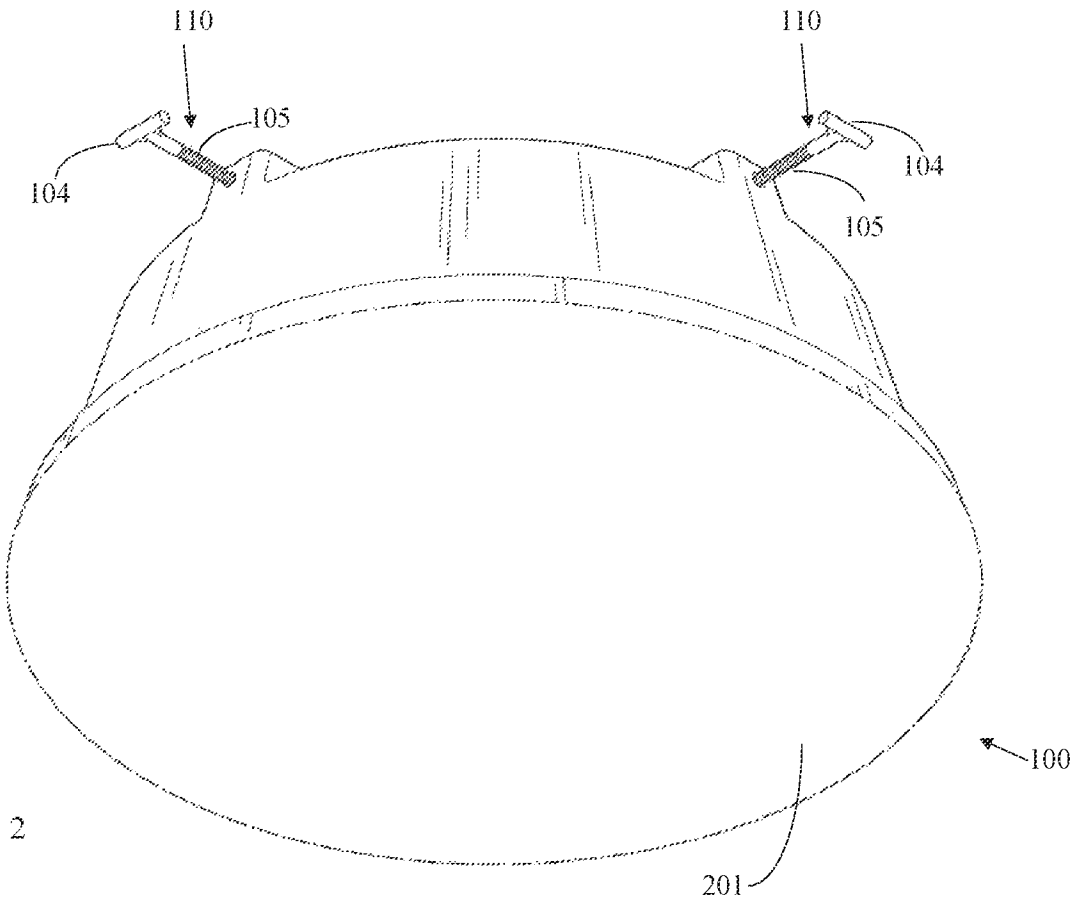
FIG. 2 depicts a bottom perspective view of an implementation of a locking tree stand.

Referring now to FIG. 2, a bottom perspective view of an exemplary embodiment of a locking tree stand with a basin 100 is shown. In many embodiments the basin 100 has a generally conical shape with a wider bottom surface 201 than the upper edge 102, however it will be understood by those skilled in the art that the present invention may be applied to a variety of shapes and sizes of base.

Figure 3:
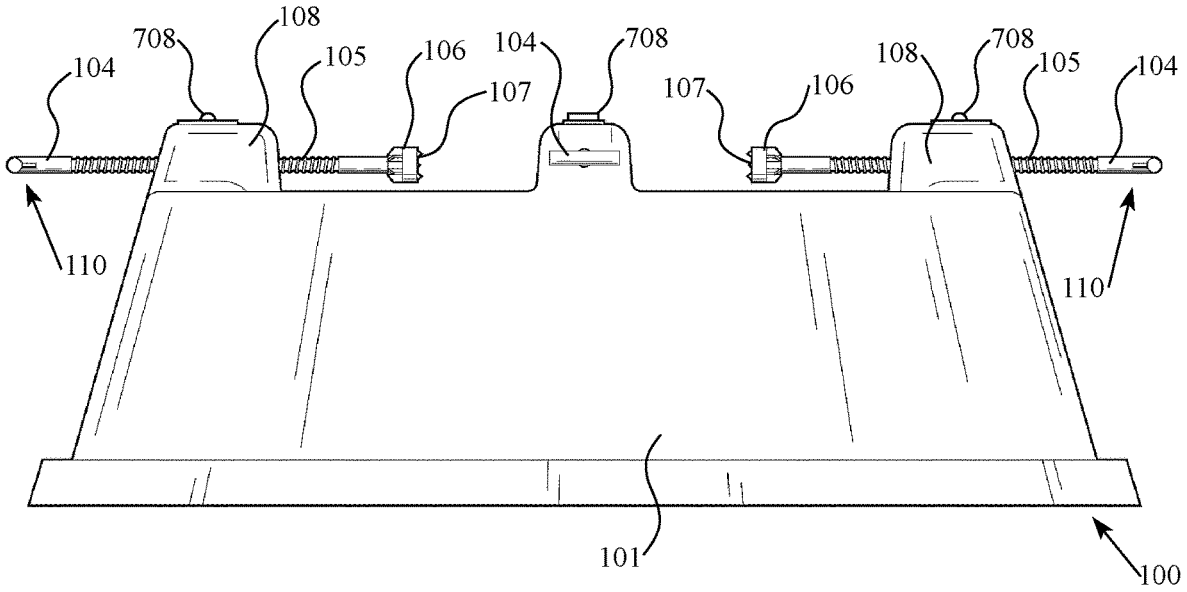
FIG. 3 depicts a side view of an implementation of a locking tree stand with four locking bolts.

Referring now to FIG. 3 an elevational view of an exemplary embodiment of a locking tree stand with a basin 100 is shown. In some embodiments four bolt mounts 108 and locking bolts 110 are used. In these and other embodiments the bolt mounts 108 have a first opening proximal to the outer wall 101 of the basin 100 and a second opening proximal to an inner wall 109 of the basin 100. The first and second opening form a channel through which the locking bolt 110 may be inserted. In many embodiments the openings are aligned such that the locking bolt 110 rests substantially parallel to the bottom surface 201, however depending on the type of tree or footpad alternative angles may be useful.

Figure 4:
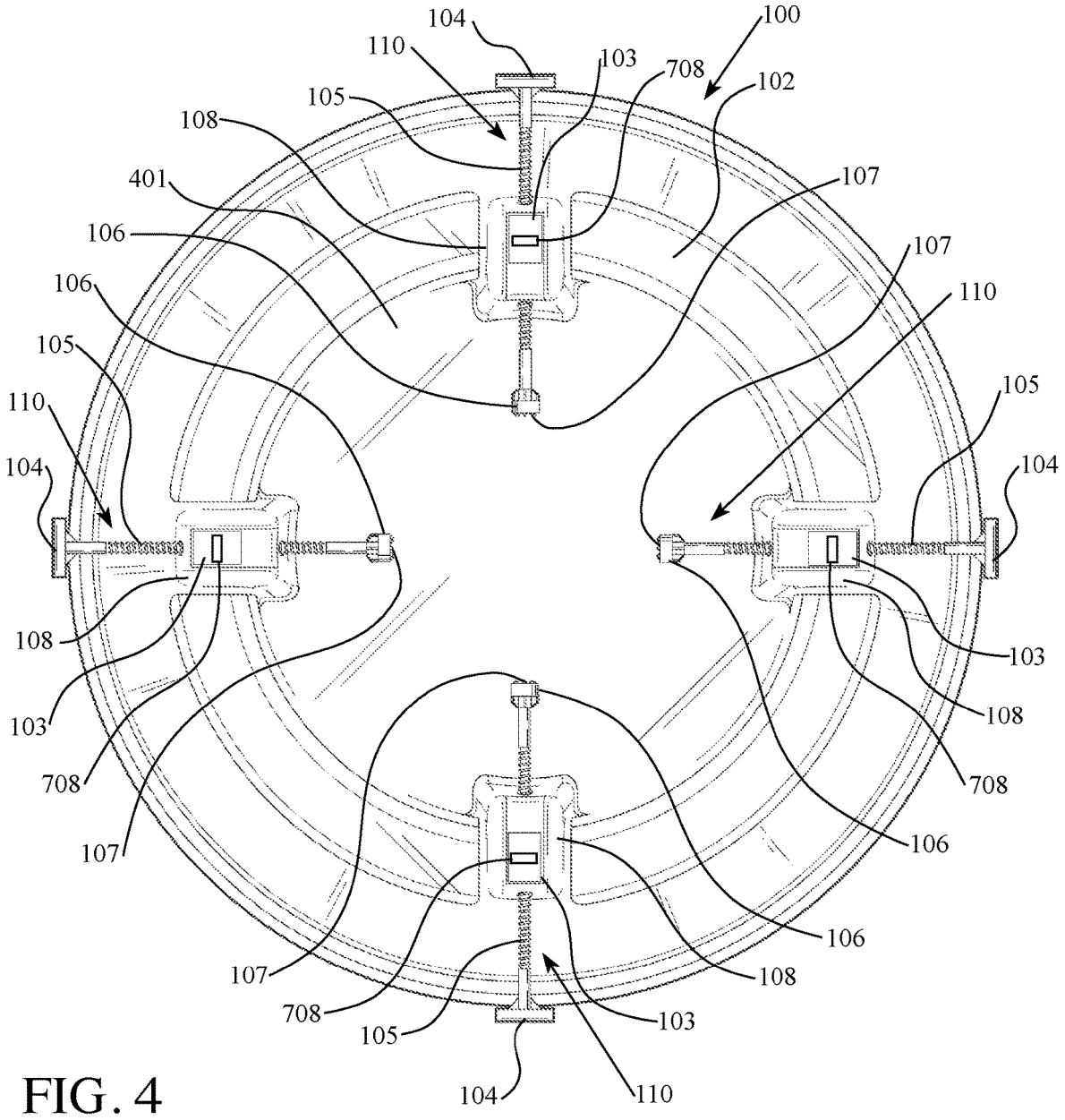
FIG. 4 depicts a top view of an implementation of a locking tree stand with four locking bolts.

Referring now to FIG. 4 a top view of an exemplary embodiment of a locking tree stand with a basin 100 is shown. In many embodiments the bolt mounts 108 may be regularly spaced along the upper edge 102 of the basin 100. On the basin 100 the four bolt mounts 108 around the circumference of upper edge 102 are placed at approximately 90-degree intervals, resulting in four evenly spaced locking bolts 110 for supporting a tree trunk. In many embodiments the basin 100 may also have an inner base 401 coupled to the inner wall 109 to allow water to be contained within the basin 100.

Figure 5:
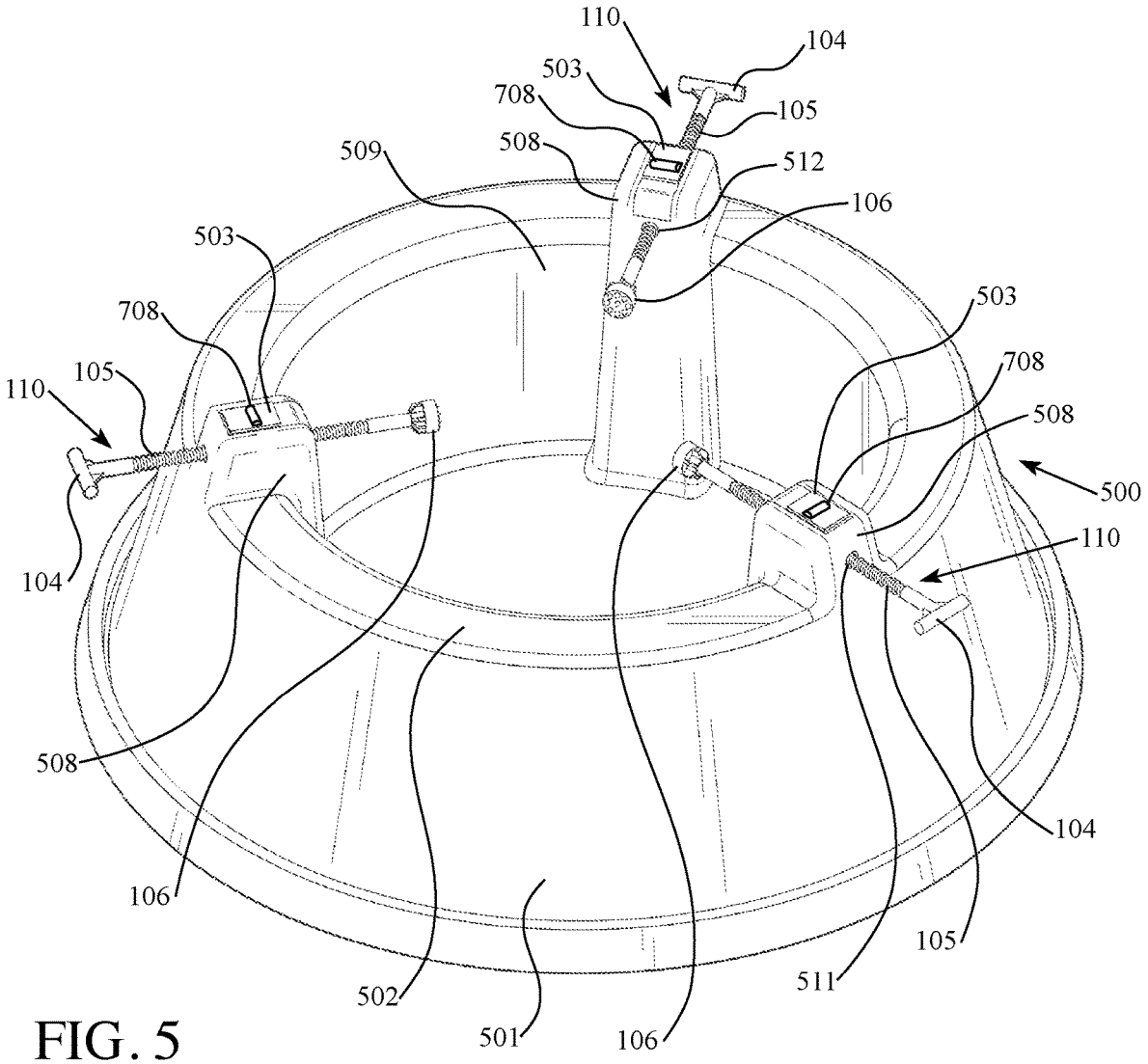
FIG. 5 depicts a top perspective view of an implementation of a locking tree stand with three locking bolts.
Figure 6:
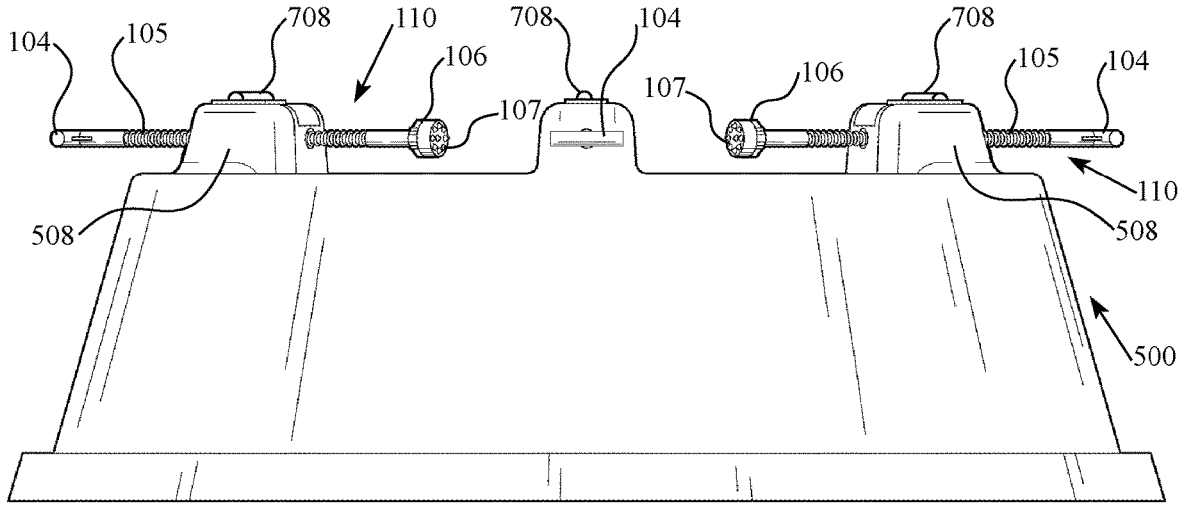
FIG. 6 depicts a side view of an implementation of a locking tree stand with three locking bolts.

Referring now to FIG. 5-6 an exemplary embodiment of a locking tree stand with a basin 500 is shown. In this embodiment an outer wall 501, an upper edge 502, and an inner wall 509 are analogous to the outer wall 101, upper edge 102, and inner wall 109 of the basin 100 in FIG. 1. In many embodiments of the basin 500 three of a bolt mount 508 having a tab 503 are disposed at approximately 120-degree intervals. In many embodiments the number of bolt mounts 508 may be varied as seen here, with three bolt mounts 508 instead of the four on basin 100. In some embodiments the number of bolt mounts 508 may vary outside of the number shown in basin 500 and basin 100. Additionally, FIG. 5 provides a clear view of the first opening 511 and second opening 512 through which the locking bolt 110 is inserted. In most embodiments the locking bolt 110 can slide through the first opening 511, passing through a channel formed within the bolt mount 508, and out of the second opening 512.

Figure 7:
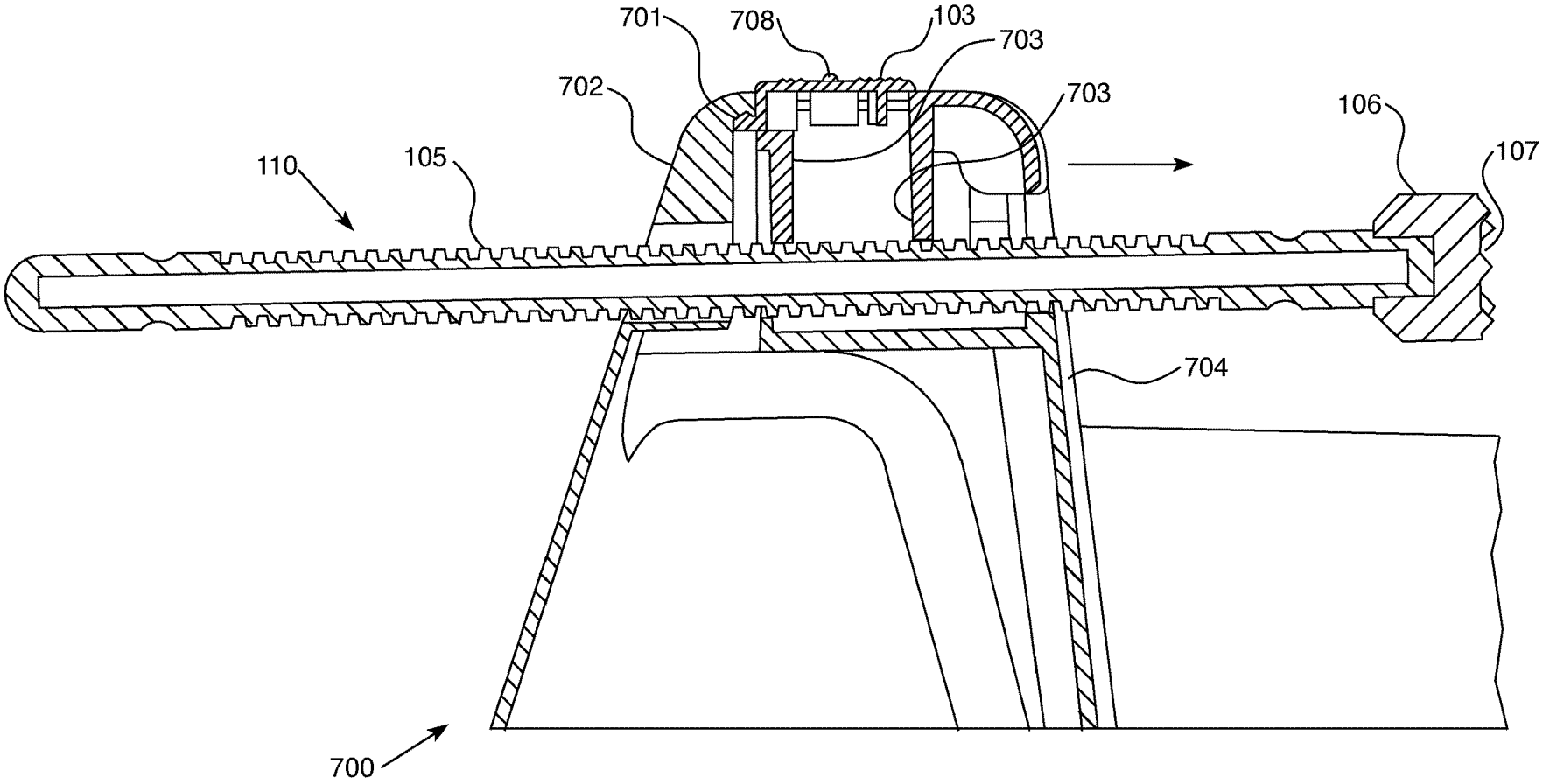
FIG. 7 depicts a cross-sectional view of an implementation of a bolt mount with a locking bolt inserted and the tab in a closed position.

Referring now to FIG. 7 a cross-sectional view of an exemplary embodiment of a bolt mount 700 with a locking bolt 110 inserted and tab 103 in the closed position is shown. In many embodiments when the tab 103 is in a closed position, a locking lip 701 may be coupled with the mount base 702. When the locking lip 701 is coupled in this position the tab 103 is prevented from moving between an open and closed position unless the tab 103 is slid away from the mount base 702 in order to decouple the locking lip 701 from the mount base 702. In many embodiments when the tab 103 is in the closed position, a pair of thread grips 703 are in contact with the threaded portion 105 of the locking bolt 110. In many embodiments when the tab is in the closed position the thread grips 703 prevent the locking bolt 110 from sliding freely within the channel created by the first and second opening of the bolt mount 700. In some embodiments the grip of the locking bolt 110 may be turned in this position to cause the locking bolt 110 to screw in or out of the bolt mount 700 in order to position the foot pad 106 and nubs 107 such that they come in contact with the tree trunk. In some embodiments an additional thread grip 704 is disposed at the second opening of the bolt mount. In other embodiments thread grip 704 may be the only grip that sits in the groove of the threaded portion 105 of the locking bolt, while the pair of thread grips 703 press against the elevated sections of the threaded portion 105 to ensure it remains in contact with the thread grip 704 and cannot freely slide within the channel of the bolt mount 700.

Figure 8:
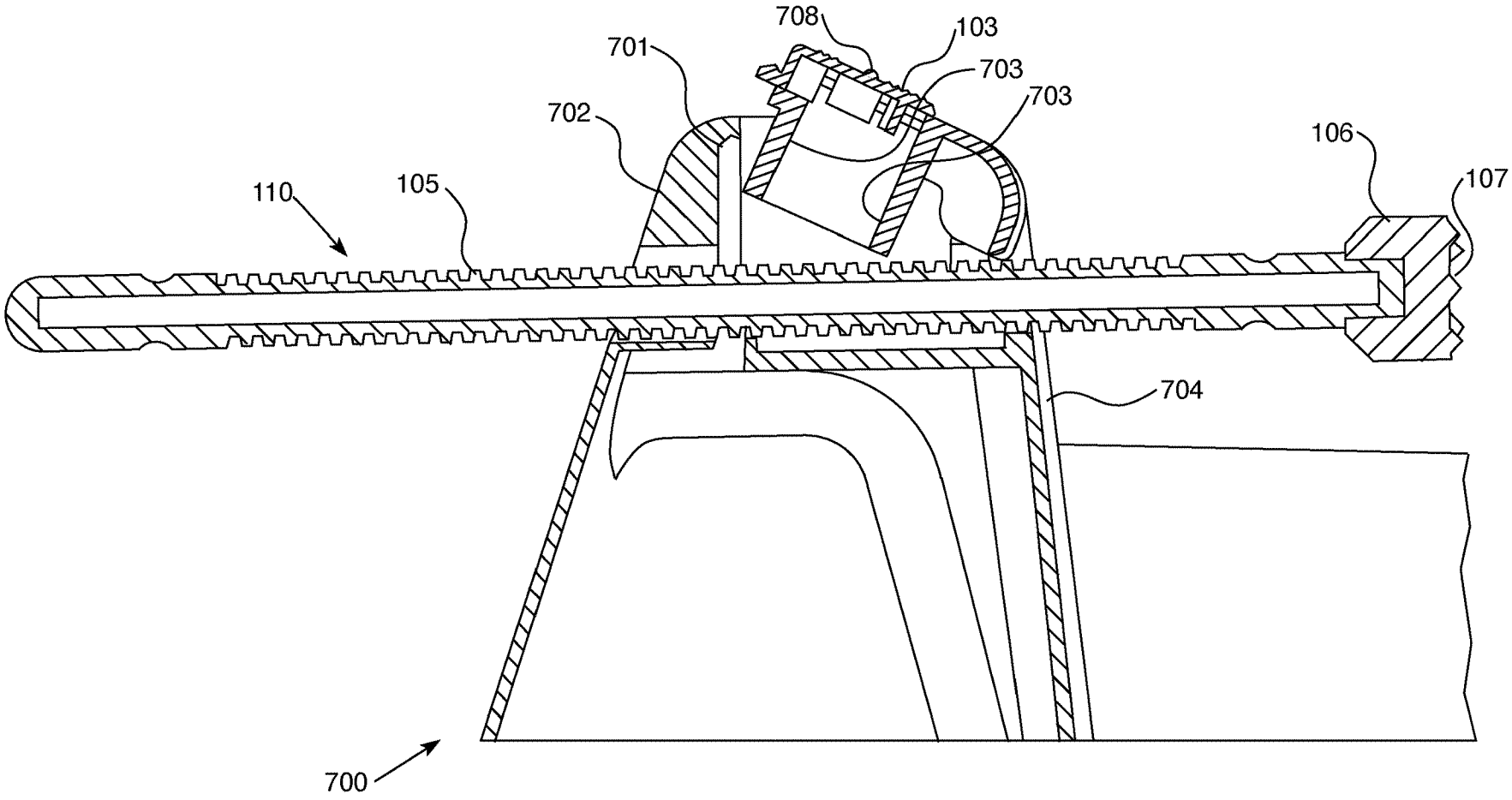
FIG. 8 depicts a cross-sectional view of an implementation of a bolt mount with a locking bolt inserted and the tab in an open position.

Referring now to FIG. 8 a cross-sectional view of an exemplary embodiment of a bolt mount 700 with a locking bolt 110 inserted and tab 103 in the open position is shown. In many embodiments when the tab 103 is slid into a position where the locking lip 701 is decoupled from the mount base 702, the tab 103 can be lifted such that the pair of thread grips 703 are no longer in contact with the threaded portion 105 of the locking bolt 110. In these and other embodiments when the tab 103 is in this open position the locking bolt 110 can slide freely within the channel. In many embodiments while the foot pad 106 is coupled to the locking bolt 110 the locking bolt 110 cannot be fully removed from the bolt mount 700. In these and other embodiments when the foot pad 106 is decoupled from the locking bolt 110 and the tab 103 is in the open position, the locking bolt 110 can be fully removed from the bolt mount 700.

Figure 9:
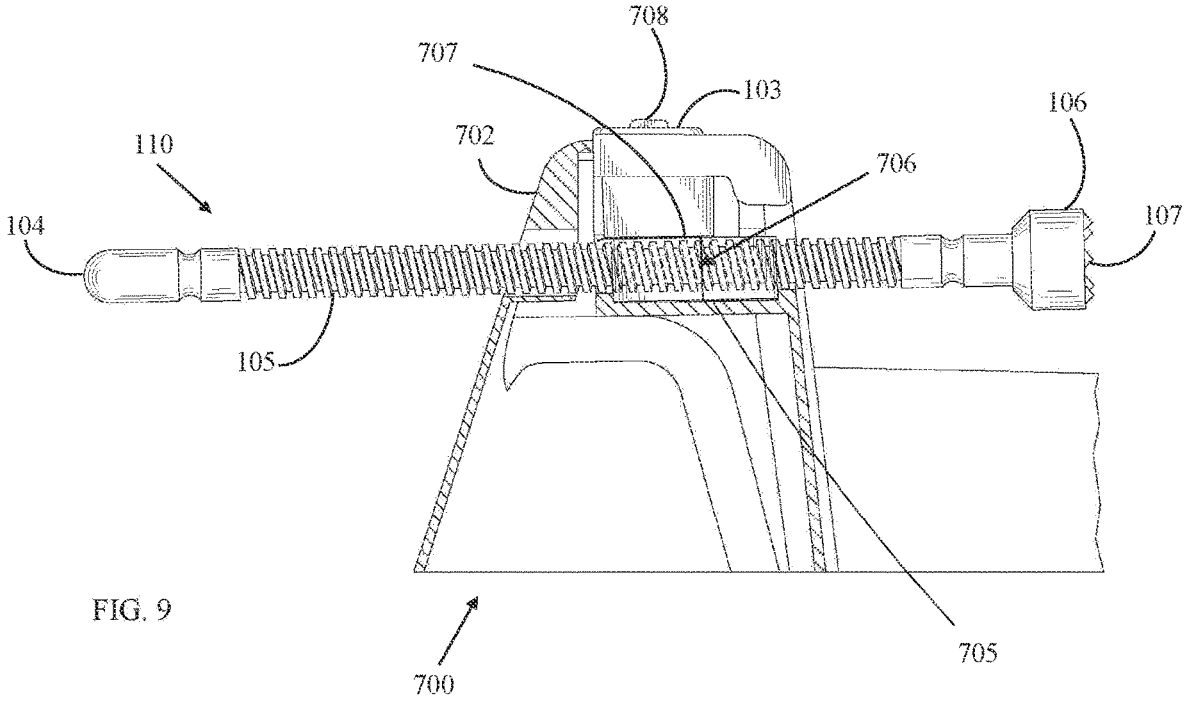
FIG. 9 depicts a cross-sectional view of an implementation of a bolt mount with a locking bolt inserted with the spring arm depressed by the bottom of the tab while the tab is in a closed position.

Referring now to FIG. 9, a cross-sectional view of an embodiment of a bolt mount 700 with a locking bolt 110 inserted and a tab 103 in the closed position is shown. In many embodiments when the tab 103 slides into the closed position, a spring 706 is in contact with the threaded portion 105 of the locking bolt 110. The spring 706 extends from the bottom of the thread base 705 and engages with the bottom of the tab 103 and the top of the threaded portion 105 of the locking bolt 110. In these and other embodiments when the tab 103 is in the closed position the locking bolt 110 cannot slide freely within the channel. In many embodiments the tab 103 can slide into the locked position using the ridge 708 extending from the top of the tab 103.

Figure 10:
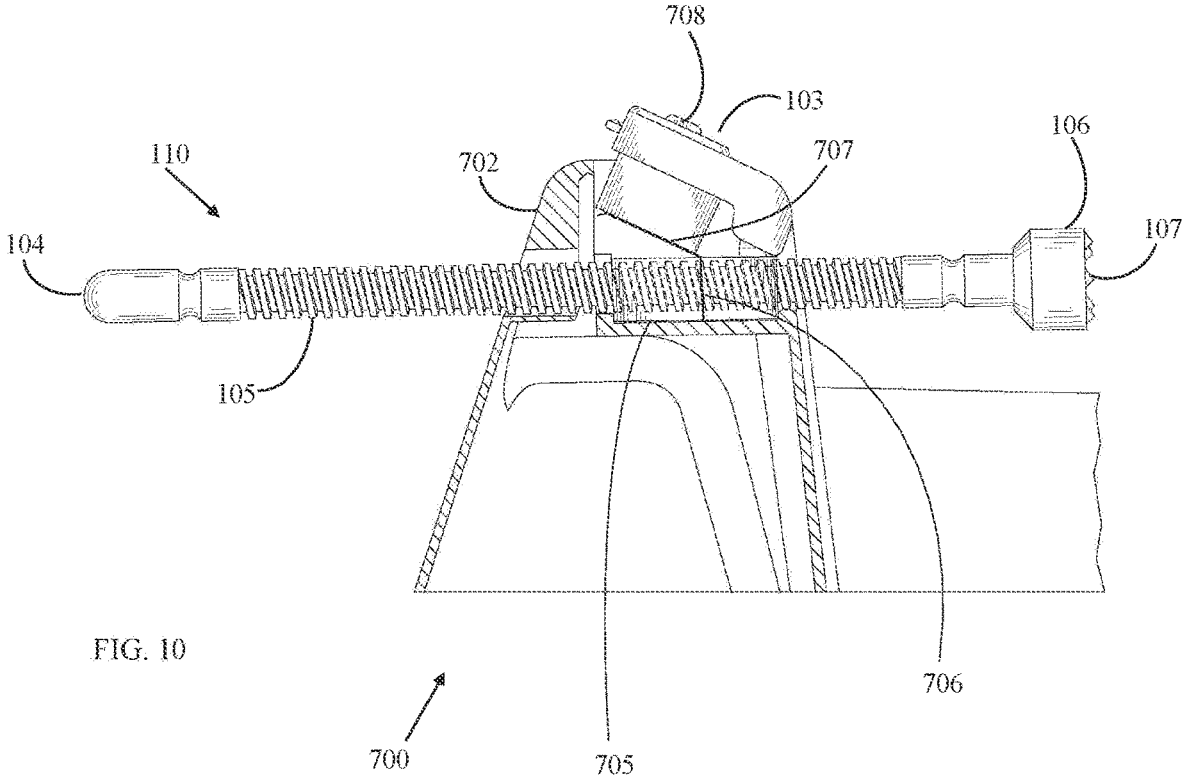
FIG. 10 depicts a cross-sectional view of an implementation of a bolt mount with a locking bolt inserted with the spring arm engaging the tab away from the top surface of the thread base while the tab is in an open position.

Referring now to FIG. 10, a cross-sectional view of an embodiment of a bolt mount 700 with a locking bolt 110 inserted and tab 103 in the open position is shown. In many embodiments when the tab 103 is not fully secured and located in the closed position, a spring arm 707 of the spring 706 is angled away from the threaded portion 105 of the locking bolt 110. The spring 706 extends from the bottom of the thread base 705 and engages with the bottom of the tab 103 to keep the tab 103 in a position that is non-parallel to the threaded portion 105 of the locking bolt 110 which serves as a visual cue to the user to recognize that the locking bolt 110 has not been secured and is still free to move freely within the channel. In these and other embodiments when the tab 103 is in the open position the locking bolt 110 can slide freely within the channel. In many embodiments the tab 103 can slide into the locked position using the ridge 708 extending from the top of the tab 103.

Figure 11:
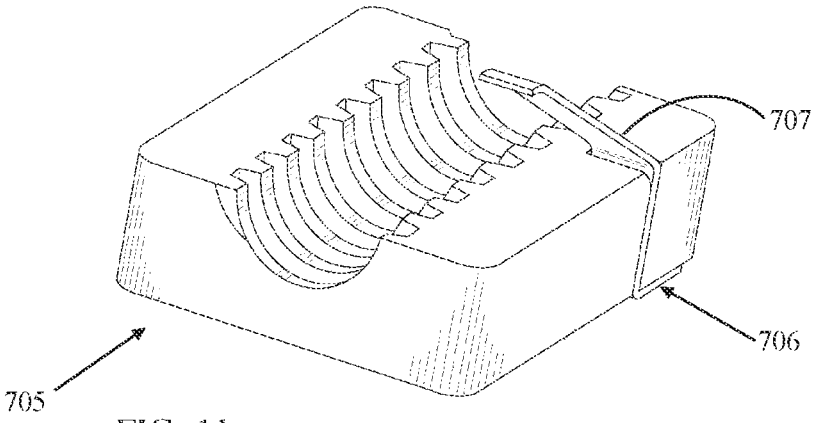
FIG. 11 depicts a top perspective view of a bottom thread base with a spring extending from the bottom of the thread base while a spring arm extends above the top surface of the thread base.

Referring now to FIG. 11 a top perspective view of the thread base 705 with a spring 706 extending from the bottom of the thread base 705. The thread base 705 forms a base where the locking bolt 110 is inserted and rests substantially parallel to the bottom surface. In many embodiments the locking bolt 110 may be inserted on the thread base 705 and the threaded portion 105 of the locking bolt 110 may also come in contact with the spring arm 707 of the spring 706. In many embodiments the spring arm 707 may be coupled to the tab 103 and the top of the threaded portion 105 of the locking bolt 110 when the tab 103 is in the closed position.

In places where the description above refers to particular implementations of systems and methods for a locking tree stand, it should be readily apparent that a number of modifications may be made without departing from the spirit thereof and that these implementations may be applied to other to systems and methods for a locking tree stand.

I claim:

1. A locking tree stand comprising:
- a locking bolt comprising:
  - a grip;
  - a threaded portion coupled to the grip; and
  - a head coupled to the threaded portion distal to the grip; and
- a basin comprising:
  - an outer wall;
  - an inner wall;
  - an upper edge coupled to the outer wall and the inner wall, the upper edge comprising:
    - a plurality of bolt mounts each comprising:
      - a thread base positioned between a first opening proximal to the outer wall and a second opening proximal to the inner wall, a space between the first opening and the second opening forming a channel configured to accommodate the locking bolt within a top surface of the thread base;
      - a spring extending from a bottom surface of the thread base, the spring comprising a spring arm that extends above the top surface of the thread base; and
      - a tab coupled apically to each of the plurality of bolt mounts and configured to rotate between an open position and a closed position, wherein in the closed position the tab is configured to couple with the threaded portion of the locking bolt and depress the spring arm such that the spring arm is substantially parallel to the top surface of the thread base; and
  - an inner base coupled to the inner wall distal to the upper edge.

2. The locking tree stand of claim 1 wherein the tab further comprises a locking lip at a first end proximal to the outer wall of the basin, the locking lip configured to couple with the bolt mount when the tab is in a locked position, the tab configured to slide between the locked position and an unlocked position with the bolt mount while the tab is in the closed position.

3. The locking tree stand of claim 1 wherein the locking bolt further comprises a footpad removably coupled to the head of the locking bolt wherein the footpad is larger than the head of the locking bolt.

4. The locking tree stand of claim 3 wherein the footpad further comprises a plurality of nubs distal to the head of the locking bolt.

5. The locking tree stand of claim 1 wherein the basin is substantially circular and wherein the plurality of bolt mounts are disposed circumferentially along the upper edge.

6. The locking tree stand of claim 5 wherein the plurality of bolt mounts are at substantially regular intervals about the circumference of the upper edge.

7. The locking tree stand of claim 1 wherein the tab couples with the threaded portion of the locking bolt via one or more thread grips extending from a bottom surface of the tab.

8. A locking tree stand comprising:
- a locking bolt comprising:
  - a grip;
  - a threaded portion coupled to the grip;
  - a head coupled to the threaded portion distal from the grip; and a footpad removably coupled to the head and being larger than the head; and a basin comprising:

an outer wall;

an inner wall;

an upper edge coupled to the outer wall and the inner wall, the upper edge comprising:

a plurality of bolt mounts each comprising:

a thread base positioned between a first opening proximal to the outer wall and a second opening proximal to the inner wall, a space between the first opening and the second opening forming a channel configured to accommodate the locking bolt within a top surface of the thread base;

a spring extending from a bottom surface of the thread base, the spring comprising a spring arm that extends above the top surface of the thread base;

a tab coupled apically to each of the plurality of bolt mounts and configured to rotate between an open and closed position, wherein a ridge extending from the top of the tab is configured to slide between a locked position and an unlocked position, the tab further comprising a locking lip wherein in the closed position the tab is configured to couple with the threaded portion of the locking bolt and depress the spring arm such that the spring arm is substantially parallel to the top surface of the thread base; and an inner base coupled to the inner wall distal to the upper edge.

9. The locking tree stand of claim 8, wherein the tab further comprises a locking lip at a first end proximal to the outer wall of the basin, the locking lip configured to couple with the bolt mount when the tab is in a locked position, the tab configured to slide between the locked position and an unlocked position with the bolt mount while the tab is in the closed position.

10. The locking tree stand of claim 8, wherein the spring further extends from the bottom of the thread base.

11. The locking tree stand of claim 8, wherein the spring arm is configured to engage with the bottom of the tab such that the spring arm is substantially non-parallel to the top surface of the thread base when the ridge extending from the top of the tab is in the unlocked position.

12. The locking tree stand of claim 8, wherein the tab is configured to depress the spring arm such that the spring arm is substantially parallel to the top surface of the thread base when the ridge extending from the top of the tab is in the locked position.

13. The locking tree stand of claim 11, wherein the spring arm is configured and arranged to angle the tab substantially less than 90 degrees from the top surface of the thread base when the ridge extending from the top of the tab is in the unlocked position.

* * * * *